US006461552B1

(12) United States Patent
Geiger

(10) Patent No.: US 6,461,552 B1
(45) Date of Patent: Oct. 8, 2002

(54) METHOD OF PRODUCING CONCRETE STONES, ESPECIALLY PAVING STONES, BUILDING STONES OR SUCH LIKE

(76) Inventor: Peter Geiger, Regensburger Strasse 160, D-92318 Neumarkt (DE)

( * ) Notice: Subject to any disclaimer, the term of this patent is extended or adjusted under 35 U.S.C. 154(b) by 0 days.

(21) Appl. No.: 09/485,735

(22) PCT Filed: May 19, 1999

(86) PCT No.: PCT/EP99/03427

§ 371 (c)(1),
(2), (4) Date: Feb. 15, 2000

(87) PCT Pub. No.: WO99/65655

PCT Pub. Date: Dec. 23, 1999

(30) Foreign Application Priority Data

Jun. 18, 1998 (DE) ..... 198 27 104

(51) Int. Cl.[7] ..... B28B 1/087; B28B 1/16; B28C 5/04; B28C 7/16

(52) U.S. Cl. ..... 264/71; 264/73; 264/74; 264/245; 264/246; 264/256; 425/130; 425/134; 425/421; 425/432; 425/447; 366/9; 366/183.2; 366/193

(58) Field of Search ..... 366/9, 183.2, 193; 264/73, 74, 71, 72, 245, 246, 247, 256; 425/130, 134, 432, 421, 447

(56) References Cited

U.S. PATENT DOCUMENTS

| | | | | | |
|---|---|---|---|---|---|
| 633,313 | A | * | 9/1899 | Hains et al. | 366/9 |
| 829,127 | A | * | 8/1906 | Strauss | 366/336 |
| 2,280,488 | A | * | 4/1942 | Jenkins et al. | 264/113 |
| 3,242,242 | A | * | 3/1966 | Bournique et al. | 106/737 |
| 3,383,442 | A | * | 5/1968 | Mountain | 156/297 |
| 3,670,060 | A | * | 6/1972 | Cuffaro et al. | 264/122 |
| 4,036,574 | A | * | 7/1977 | Jakobs et al. | 425/425 |
| 4,094,941 | A | * | 6/1978 | Manners et al. | 264/256 |
| 4,207,009 | A | * | 6/1980 | Glocker | 366/337 |
| 5,248,338 | A | * | 9/1993 | Price | 106/712 |
| 5,795,513 | A | * | 8/1998 | Austin | 264/245 |
| 5,855,958 | A | * | 1/1999 | Nash | 264/133 |

FOREIGN PATENT DOCUMENTS

| | | | | |
|---|---|---|---|---|
| BE | 401 251 | | 3/1934 | |
| DE | 19 29 954 | | 10/1965 | |
| DE | 27 05 714 | | 8/1978 | |
| DE | 39 09 169 | | 10/1989 | |
| DE | 195 36 568 | | 4/1997 | |
| FR | 611 493 | A | 9/1926 | |
| FR | 2622188 | A * | 4/1989 | C04B/14/28 |
| JP | 10-128718 | A * | 5/1998 | B28B/3/02 |

* cited by examiner

*Primary Examiner*—Jan H. Silbaugh
*Assistant Examiner*—Michael I. Poe
(74) *Attorney, Agent, or Firm*—Collard & Roe, P.C.

(57) ABSTRACT

A device and a method for producing concrete paving stones. These paving stones can be made from coarse grained concrete and a series of layers of colored concrete material. These layers of colored concrete material are placed in a container on top of a slider that is transversely displaceable. There is also an additional slider and a closing member disposed at the bottom of the container. The first slider, can be moved to form a passage slot between the first slider and the housing. The second slider can be moved to form a passage slot between the second slider and the housing. In addition, between the first slider and the second slider is a first deflecting curve for the colored concrete to mix around and between the second slider and the closing member is a second deflecting curve for further mixing of the colored concrete. This colored concrete is then added to the coarse grained concrete and compacted with it to create paving stones.

11 Claims, 3 Drawing Sheets

METHOD OF PRODUCING CONCRETE STONES, ESPECIALLY PAVING STONES, BUILDING STONES OR SUCH LIKE

BACKGROUND OF THE INVENTION

The invention relates to a method of producing concrete stones, in particular paving stones, building stones or the like, with a base part made of coarsely grained concrete, and a facing layer made of colored concrete mortar that solidly covers the top side of the base part, whereby the coarsely grained concrete is filled in a shaping tool and compacted in said shaping tool by vibrating and/or pressing, and in the lowered chamber of the shaping tool, the colored concrete mortar coming from a supply container is applied to the coarsely grained concrete as the facing layer and then compacted.

It is known to take dyed concrete mortar to be used as a facing layer for concrete stones out of a supply reservoir by means of gravity. If the facing layer is a multi-colored, for example a marbleized facing layer, mortar compounds are transported separated by color with conveyor belts and then filled into the supply container, and thereafter fed into the shaping tools either mixed or unmixed. It is known, furthermore, to feed mortar compounds of different colors into the supply container with help of additional containers associated with the supply container, and to then transfer said compounds from such a supply container into the molding tools. The known methods and devices have the common drawback that they require much expenditure in terms of machinery and manufacturing technology. In addition, the facing layers so produced show in many cases undefined color patterns due to unfavorable mixing resulting from the formation of heaps.

The problem of the invention is to provide a method that permits with low expenditure the manufacture of marbleized facing mortar for producing facing layers with a defined outward appearance that truthfully reflects the desired pattern.

SUMMARY OF THE INVENTION

Said problem is solved according to the invention in that the concrete mortar forming the facing layer is produced by layers dyed in different colors. Said layers are stored in the supply container at the top, where they are stacked in layers one on top of the other, then freely transported down jointly and simultaneously in partial sections by means of gravity, and on their way then collide with a baffle element projecting into the path of travel of the partial sections, and are then guided along said baffle element, guided by at least one deflecting curve, and are subsequently mixed with each other in order to form with the multi-colored concrete mortar on the coarsely grained concrete a marbleized facing layer that then needs to be compacted. The baffle element permits automatic adjustment of the deflecting curves in the supply container, and in particular predetermined mixtures of said partial sections owing to the transverse shifting of the partial sections occurring in the course of such adjustments. According to preferred steps of the method, the dyed layers are stored in the supply container stacked one on top of the other on a transversely adjustable slider, and can be freely moved downwardly by gravity with the help of said slider via an opening slot formed between the slider and the wall of the container, by moving the slider longitudinally. In this process, the layers are mixed with each other by the baffle element and the deflecting curves, and transferred in portions into the shaping tool as multi-colored concrete mortar by a closing member located at the bottom end of the supply container.

For carrying of the method, provision is made for a device which is characterized by an upright, hopper-shaped supply container with a transversely movable slider mounted in the supply container as a bearing element for layers of differently colored concrete mortar stacked one on top of the other; by an adjustable passage slot located between the slider and the wall of the supply container for partial sections of the layers being automatically movable downwardly by means of gravity; and by another slider located with a spacing beneath the slider serving as the bearing element, said other slider serving as a baffle and guide element for partial sections of the colored layers, and jointly forming with the wall of the container an additional, preferably variable passage slot for the partial sections; and in that the partial sections of the layers can be guided and mixed in the passage slots on deflecting curves; and furthermore by a displaceable and/or pivot-mounted closing member for quantitatively controlling portioned dispensing of the colored concrete mortar, said closing member being arranged on the supply container with a spacing below the slider serving as the baffle element. For the purpose of forming the deflecting curves and achieving offset passages, the two sliders are longitudinally displaceable against each other in the supply container, said two sliders forcibly guiding the concrete mortar in the deflecting curves. By changing the opening width of the passages it is possible to vary the deflecting curves and to obtain changes in the mixture. Furthermore, the passage formed by the closing member may be offset relative to the baffle element. Deflecting curves can be formed in this way that guide the concrete mortar through the supply container in opposite directions of rotation. Offsetting the passages on the sliders and on the closing member in this way may lead to a deflecting curve for the partial sections that extends, for example between the sliders in the clockwise direction, whereas an adjoining deflecting curve is adjusted against the clockwise direction between the sliders serving as the baffle element, and the closing member. It is understood that the colored concrete mortar can be guided also on deflecting curves rotating in opposite directions.

As a further development of the device, provision is made that the slider acting as the baffle element is designed in the form of a plane or curved molded part, which is arranged in the supply container in a fixed way or pivot-mounted therein. Furthermore, it is possible also the design the baffle element in some other way, for example in the form of a prism-shaped element arranged fixed or movable in the supply container, whereby said prismatic element preferably has a triangular cross section, for example in the form of a triangle with equally dimensioned legs or equal sides.

Finally, provision is made that the sliders serving as bearing and baffle elements, and the closing member for the partial sections of the colored layers of the concrete mortar are formed in any desired way by displaceable and/or by pivoting elements shaped in a plane or curved way.

A device for carrying out the method is shown in the figures, where

DETAILED DESCRIPTION OF THE PREFERRED EMBODIMENT

Figure 1:
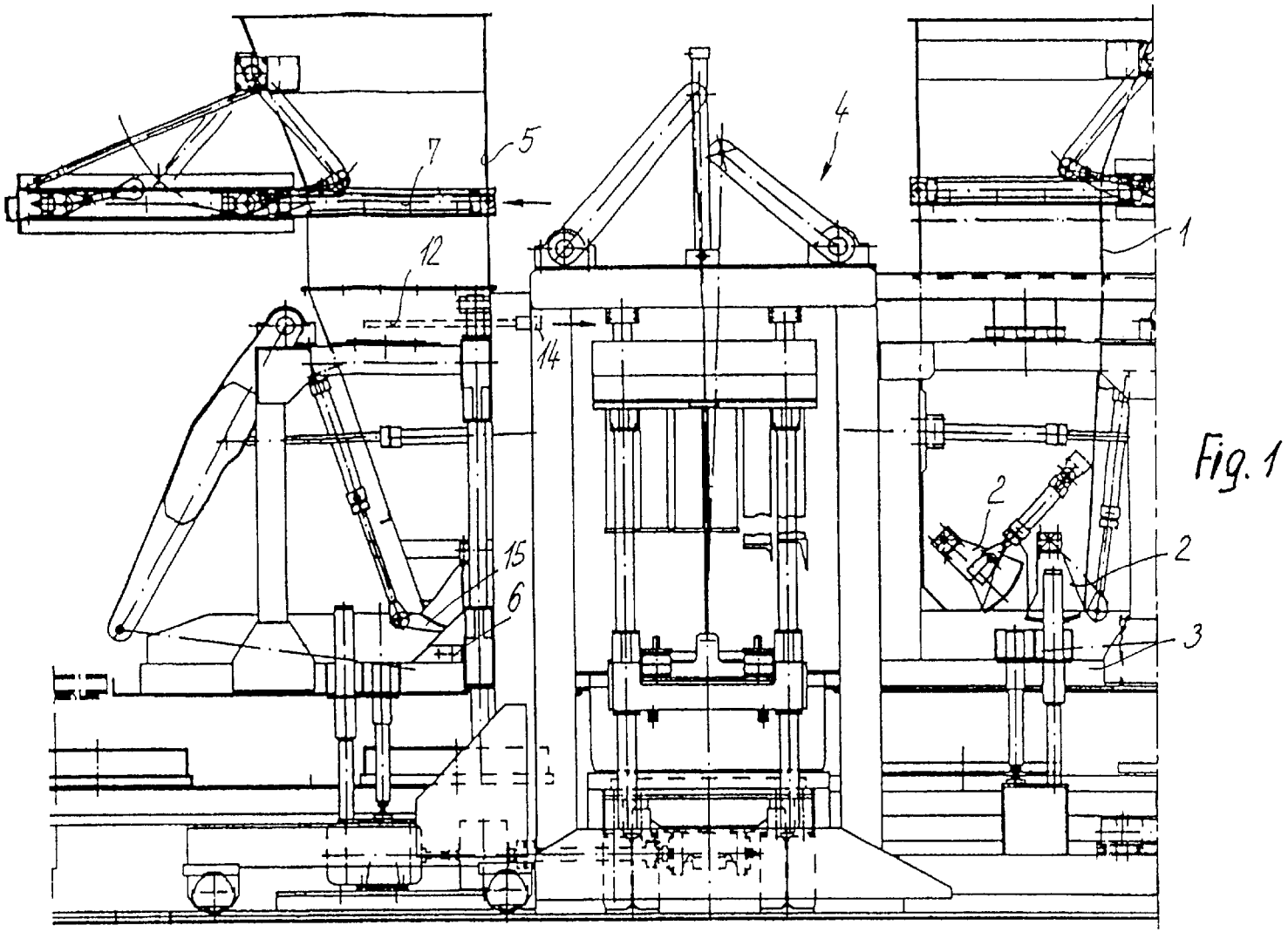
FIG. 1 shows a side view of the device.
Figure 2:
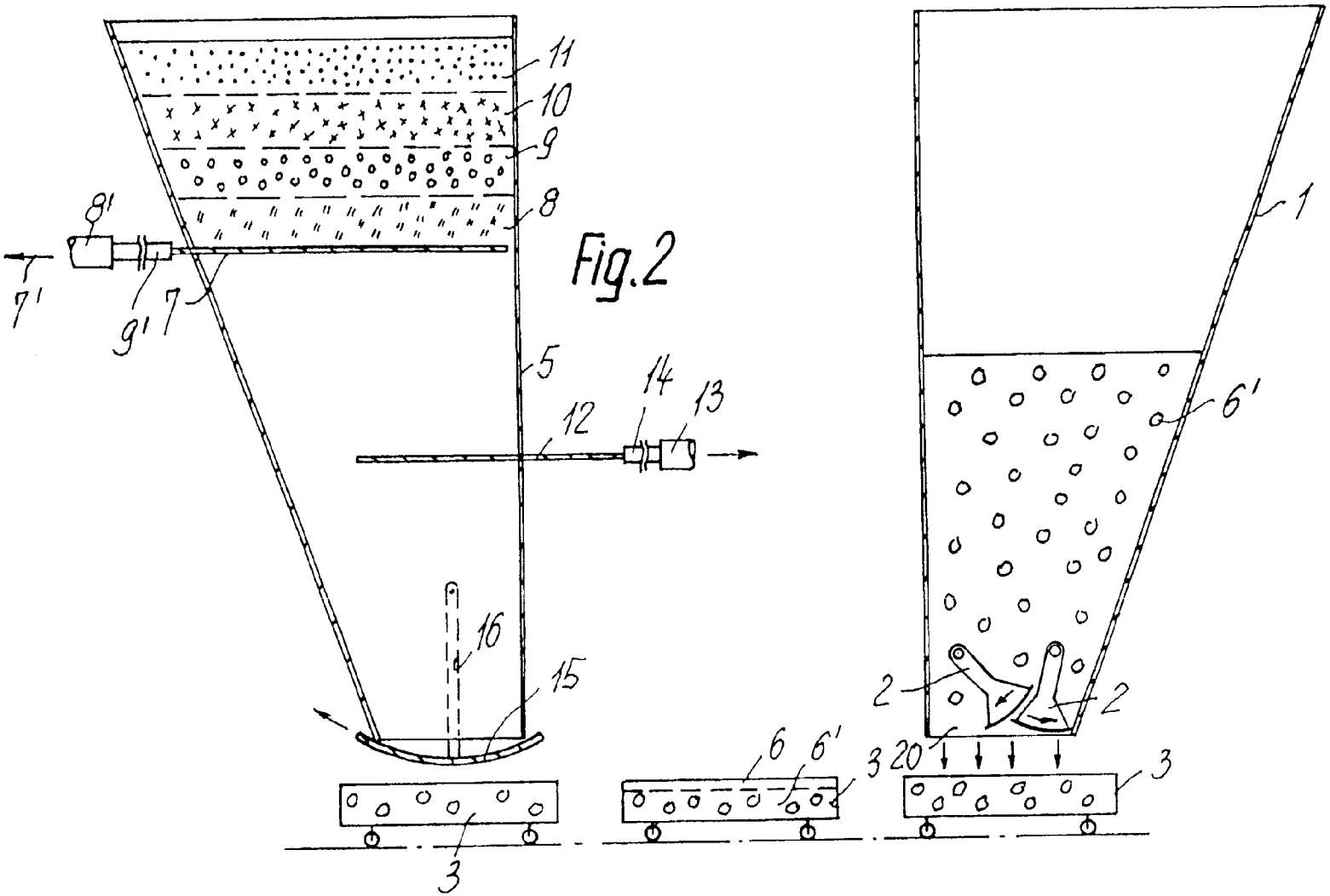
FIG. 2 shows a schematic, enlarged section through a device.

FIG. 1 shows a container 1 serving the purpose of receiving the coarsely grained concrete 6', which can be supplied to a shaping tool 3 located beneath said container, by way of the closing members 2. Reference numeral 4 denotes a vibrating or pressing station, whereas reference numeral 5 denotes a supply container for receiving concrete mortar for forming a colored, in particular a marbleized facing layer 6 for the coarsely grained concrete 6'. The supply container 5 has the shape of a hopper and is fitted near the top end with a slider 7. The layers 8, 9, 10 and 11 of concrete mortar dyed in different colors are stored stacked one on top of the other on the slider 7. Said layers are jointly used for producing facing layers. The slider 7 can be driven from its closing position shown in FIGS. 1 and 2 in the direction indicated by the arrow 7' into its operating position according to FIG. 3 by means of a piston 9 guided in a cylinder 8. Furthermore, the supply container 5 accommodates with a spacing below the slider 7 another slider 12 acting as a baffle element, said other slider 12 being movable by a piston 14 guided in a cylinder 13 as well. A closing member 15 is associated with the lower end of the supply container 5. Said closing member 15 is pivot-mounted in the supply container 5 by means of a lever system 16.

It is assumed that the coarsely grained concrete 6' is first transferred from the supply container 1 into the shaping tools 3, and then compacted at 4 by vibrating or pressing (FIG. 1). The space created in this way in the shaping tool 3 above the compacted coarsely grained concrete 6' serves for receiving colored facing mortar. For this purpose, the colored layers 8, 9, 10 and 11 stored on the slider 7 are transported, as it can be seen in FIG. 3, in the direction indicated by the arrow 7', by actuating the slider 7 and through the formation of a passage opening 7", said layers moving jointly and simultaneously by gravity in partial sections downwardly in the direction of the lower end of the supply container 5. While moving down, the partial sections of the concrete mortar are guided by the slider 12 onto a deflecting curve, said slider 12 having been moved into its working position to act as a baffle plate; then mixed with each other with the cooperation of the slider 12 and the deflecting curve; and are then transported and additionally mixed along another deflecting curve in the direction of the closing member 15. By opening of the closing member 15, the colored partial sections of the layers 8, 9, 10 and 11 are received as a mixture in the shaping tool 3 via the passage opening 20 in the form of a marbleized facing layer 6. By driving the shaping tool 3 into the pressing station 4, the facing layer subsequently can be compacted. Mixing of the layers 8, 9, 10 and 11 is therefore accomplished without mechanical expenditure.

A slider 7 in the device according to FIG. 4 again serves for storing the colored layers 8, 9, 10 and 11 of the concrete mortar. A pivot-mounted baffle element 12 is supported on the supply container 1 below the slider 7 with a spacing in between. Serving as a baffle plate for the partial sections of the layers 8, 9, 10 and 11, said baffle element projects into the path of travel of said layers moving to the deflecting curves, and serves for mixing the partial sections. The bottom end of the supply container 5 can be closed and opened by a slider 15 serving as the closing element.

Figures 3, 4, 5:
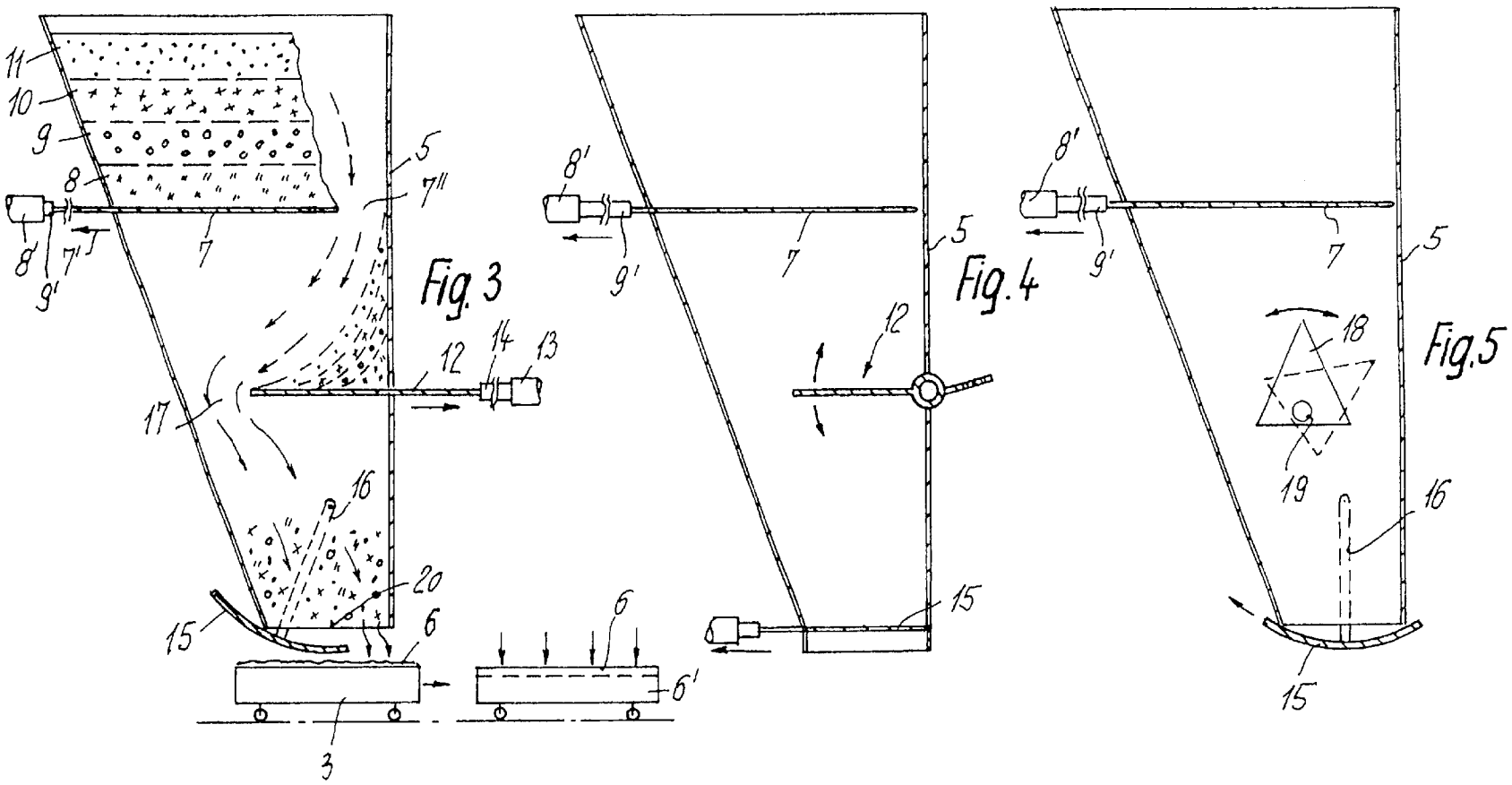
FIG. 3 shows a schematic, enlarged sectional view of a device in the operating position.
FIG. 4 shows a schematic section through a device according to a modified embodiment.
FIG. 5 is a schematic sectional view of another type of device.

In FIG. 5, provision is made for a slider 7 for storing the colored layers 8, 9, 10 and 11 in the supply container 5, and for a closing member 15 located at the bottom end of the supply container 5, said closing member being pivot-mounted and arranged in accordance with FIG. 3. In a deviating way, a prism-shaped element 18 is selected in the present embodiment to act as the baffle element, said prismatic element being designed in the present exemplified embodiment in the form of a triangle with equal legs, viewed in the cross section. The prismatic element 18 is pivot-mounted in the supply container 5, turning about an axle 19, and permits forming passage slots with different sizes of width. The prismatic element 18 permits deflecting curves to be formed and acts as a baffle plate for the partial sections of the layers 8, 9, 10 and 11.

After the slider 7 has been completely emptied, the residual amounts of mortar remaining on the slider 12 (FIG. 3) can move by gravity along a reflecting curve in the direction of the closing member 15, and then onwards to the shaping tool by causing the slider 12 to move outwardly.

It is in conformity with the present invention that it is possible according to the method and by means of the device to produce any desired type of stone bodies made of concrete materials, for example in addition to paving and building stones also, for example panels, split stones, facing bricks and the like with a color, in particular with a marbleized facing layer made of concrete material. Finally, it is possible also to employ the method and the device in connection with stone bodies of any desired type and shape that are wholly formed by dyed concrete materials.

What is claimed is:

1. A method for producing paving stones or building stones having a basic body formed by coarse concrete and a concrete marble facing layer consisting of colored concrete solidly covering the basic body of course concrete on the top side, comprising the following steps:

a) filling coarse concrete in a molding tool located below a lower space of a supply container;

b) compacting the coarse concrete by shaking or pressing the coarse concrete in the molding tool;

c) applying a plurality of partial segments of colored concrete to the coarse concrete in the molding tool from the lower space of the supply container to form the concrete marble facing layer on the coarse concrete via the following steps:

i) supporting a plurality of differently colored partial segments of colored concrete near the top of the supply container, one stacked on top of the other on a first transversely displaceable slide;

ii) displacing the first slide transversely to allow the partial segments of the colored concrete to move jointly, simultaneously, and freely down toward the lower space of the supply container via a passage slot formed between the first slide and a wall of the supply container wherein the partial segments of colored concrete move along a deflecting curve by force of gravity;

iii) displacing transversely an additional slide serving as a baffle element wherein the additional slide projects into the path of movement of the partial segments of colored concrete and is variably spaced from the wall of the supply container, the additional slide guiding the partial segments of colored concrete along at least one additional deflecting curve;

wherein the partial segments of colored concrete are mixed with each other as the partial segments of colored concrete move along the deflecting curves; and d) compacting the concrete marble facing layer to the coarse concrete.

2. The method as in claim 1, where the step of applying a plurality of partial segments of colored concrete further comprises the step of dispensing to the molding tool the partial segments of the colored concrete via a closing element of the supply container.

3. The method as in claim 1, wherein the step of applying a plurality of partial segments of colored concrete to the coarse concrete in the molding tool includes completely filling the molding tool with colored concrete to form stones dyed all the way through, wherein the colored concrete mortar is subsequently compacted in the molding tool.

4. A device for producing paving stones or building stones by by mixing a plurality of partial segments of colored concrete, the device comprising:

a) an upright supply container having at least one substantially vertical side;

b) a slide which is transversely displaceable and disposed inside of the supply container, said slide being displaceable from at least one substantially vertical side on the supply container to form a variable passage slot for partial segments of colored concrete between the slide and at least one substantially vertical side on the supply container, the variable passage slot having a deflecting curve;

c) an additional slide which is transversely displaceable and disposed within the supply container and below the slide, the additional slide being displaceable from at least one substantially vertical side on the supply container to form an additional variable passage slot for partial segments of colored concrete between the additional slide and at least one substantially vertical side on the supply container, the additional variable passage slot having an additional deflecting curve and being offset from the variable passage slot;

d) a closing element swivel-mounted in the supply container, below the additional slide, wherein the closing element controls quantitative dispensing of colored concrete from the supply container; and e) a molding tool located below the closing element of the supply container, the molding tool having means for shaking or pressing concrete dispensed therein;

wherein the device produces paving stones or building stones having a basic body formed by coarse concrete and a concrete marble facing layer consisting of colored concrete solidly covering the basic body of coarse concrete on a top side, by:

filling coarse concrete in the molding tool from a lower space of the supply container, compacting the coarse concrete by shaking or pressing the coarse concrete in the molding tool, applying a plurality of partial segments of colored concrete to the coarse concrete in the molding tool from the lower space of the supply container to form the concrete marble facing layer on the coarse concrete, wherein a plurality of differently colored partial segments of colored concrete are first supported near the top of the supply container, one segment stacked on top of the other on the slide, displacing the slide from at least one substantially vertical side of the supply container to allow the partial segments of the colored concrete to move jointly, simultaneously, and freely down toward the lower space of the supply container via the variable passage slot such that the partial segments of colored concrete move along the deflecting curve by force of gravity and then transversely displacing the additional slide from at least one substantially vertical side of the supply container such that the additional slide guides the partial segments of colored concrete through the additional variable passage slot along the additional deflecting curve whereby the partial segments of colored concrete are mixed with each other as the partial segments of colored concrete move along the deflecting curves, and compacting the concrete marble facing layer to the coarse concrete.

5. The device as in claim 4, wherein the slide and the additional slide are longitudinally displaceable against each other in the supply container wherein the slide and the additional slide form deflecting curves which are formed by the variable passage slot and the additional variable passage slot.

6. The device as in claim 4, wherein the closing member and the supply container are joined together to form a passage opening offset relative to the additional passage slot.

7. The device as in claim 4, wherein the slide and the additional slide form a deflecting curve in a clockwise direction of rotation for the partial segments of colored concrete, and wherein the additional slide and the closing member form an additional deflecting curve in a counter clockwise direction.

8. The device as in claim 4, wherein the slide, the additional slide and the closing member are flat plates.

9. The device as in claim 4, wherein the slide, the additional slide and the closing member are curved elements.

10. The device as in claim 4, wherein the additional slide is formed by a prism shaped element rotatably disposed in the supply container, the prism shaped element having a triangularly shaped cross section.

11. The device as in claim 10, wherein the prism shaped element has the shape of a triangle with equal legs or equal sides.

* * * * *